US006959766B2

(12) United States Patent
Connell

(10) Patent No.: US 6,959,766 B2
(45) Date of Patent: Nov. 1, 2005

(54) DOWNHOLE BALL DROP TOOL

(75) Inventor: Michael L. Connell, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 98 days.

(21) Appl. No.: 10/646,482

(22) Filed: Aug. 22, 2003

(65) Prior Publication Data

US 2005/0039925 A1 Feb. 24, 2005

(51) Int. Cl.[7] ..... E21B 34/06; E21B 34/10
(52) U.S. Cl. ..... 166/373; 166/318; 166/332.4
(58) Field of Search ..... 166/373, 192, 166/193, 318, 332.4, 396

(56) References Cited

U.S. PATENT DOCUMENTS

| | | | | |
|---|---|---|---|---|
| 1,518,865 | A | 12/1924 | McKissick | |
| 4,491,177 | A | 1/1985 | Baugh | |
| 5,335,727 | A | 8/1994 | Cornette et al. | 166/278 |
| 6,220,360 | B1 | 4/2001 | Connell et al. | |
| 6,390,220 | B1 | 5/2002 | Allamon et al. | 166/376 |
| 6,715,541 | B2 * | 4/2004 | Pedersen et al. | 166/75.15 |
| 6,776,228 | B2 * | 8/2004 | Pedersen et al. | 166/75.15 |
| 2004/0055753 | A1 * | 3/2004 | Davis et al. | 166/318 |

FOREIGN PATENT DOCUMENTS

| | | | |
|---|---|---|---|
| EP | 1 132 565 A3 | 9/2001 | E21B 23/00 |
| WO | WO 2004/011770 A3 | 2/2004 | E21B 34/14 |

OTHER PUBLICATIONS

Foreign communication from a related counterpart application dated Sep. 13, 2004.

* cited by examiner

*Primary Examiner*—William Neuder
(74) *Attorney, Agent, or Firm*—John W. Wustenberg; McAfee & Taft

(57) ABSTRACT

A ball drop tool for dropping an actuating ball to a ball seat located in a tool or tool string therebelow. The ball drop tool includes a housing with a ball drop cage positioned therein. The ball drop cage has a rocker arm pivotably attached thereto. In a first position, the rocker arm retains the actuating ball in the housing and in the second position releases the actuating ball so that it is displaced downwardly to engage the ball seat therebelow in the tool string. The ball drop cage may be connected to a releasing seat sleeve thereabove. Downward movement of the releasing seat sleeve from a first position to a second position after landing a releasing ball on the releasing sleeve moves the ball drop cage from the first position to the second position to release the actuating ball.

23 Claims, 4 Drawing Sheets

DOWNHOLE BALL DROP TOOL

BACKGROUND

The present invention relates generally to a ball drop tool, and more particularly to a ball drop tool to be connected in a tool string lowered into a wellbore with coiled tubing.

In the drilling and completion of oil and gas wells, a wellbore is drilled into the subterranean producing formation or zone of interest. A string of pipe, e.g., casing, is typically then cemented into the wellbore. Oftentimes, a second string of pipe, commonly referred to as a liner, is attached at the lower end of the casing and extends further into the wellbore. Casing, when referred to herein, includes liners. A string of additional pipe, known as production tubing, is often lowered into the casing and/or the liner for conducting produced fluids out of the wellbore.

It is often necessary to lower downhole tools, such as packers or other tools into the casing, liner or production tubing to perform a desired operation. Many known downhole tools, such as but not limited to hydraulic disconnects, circulating subs, and inflatable packers require a ball to be displaced down a tool string to engage a ball seat disposed in the tool. Typically, pressure is applied after the ball engages the seat to actuate a mechanism in the tool. For example, with an inflatable packer, the ball may engage a seat to direct fluid into the inflatable elements of the packer, so that the packer will engage the casing, liner, or production tubing. The foregoing are merely examples and there are a number of known tools that utilize and require a ball to engage a ball seat so that pressure can be applied in the tool above the seat to actuate a mechanism in the tool string.

Coiled tubing is a popular conveyance method for downhole tools, and the use of dropped balls to engage a seat in a tool lowered into the wellbore with coiled tubing is becoming more and more common. When coiled tubing is utilized to lower a tool into a wellbore, and it is necessary to drop a ball to engage a seat in the tool, the ball may be manually inserted into the surface plumbing for the coiled tubing, so that the ball enters the coiled tubing at, or near the end of the tubing connected to the surface plumbing. The ball therefore enters the coiled tubing so that it must be pumped through the coiled tubing wraps on the reel, until it passes over a gooseneck which is utilized in connection with the coiled tubing. Pumping then continues for a period of time to ensure that the ball has made its way through the coiled tubing to the seat in the downhole tool. Although such a method works in many circumstances, there are several drawbacks to this method.

The method described above for displacing a ball through coiled tubing is time-consuming and costly. It requires the usage of a large volume of fluid since at least one displacement volume of the coiled tubing is needed to get the ball around the wraps and to the downhole tool. Occasionally, balls are caught in the coiled tubing and never make it to the tool.

In addition, there are times when downhole devices above the ball seat have restrictions which would prevent a ball from passing therethrough to the ball seat in the tool. For example, filter screens are often run downhole to keep debris from plugging off small passages in the tools below. Actuating balls cannot pass through the screens. Likewise, it is possible that a tool having a small diameter would be positioned above the ball seat and thus would prevent the ball from passing therethrough. The invention disclosed in U.S. Pat. No. 6,220,360 (the '360 patent), owned by the assignee of the current invention, which is incorporated herein by reference in its entirety, addresses these needs by providing a flow-activated ball dropper that carries an actuating ball into the well and launches the ball when a predetermined flow rate is achieved. While the invention described in the '360 patent works well, there is a continuing need for new methods and apparatus that can be used when devices in a tool string have restrictive diameters or flow passages that would prevent an actuating ball or other actuating device of a desired size from passing therethrough. The present invention addresses the above needs by providing a downhole ball drop tool that can be positioned in the tool string below any tools with restrictive diameters or flow passages, and above the actuating seat in the tool such that the ball does not have to pass through restrictive flow passages. The ball drop tool of the current invention will release the actuating ball at a desired time, and provides certainty that the actuating ball has been released to engage the actuating seat.

SUMMARY

The present invention is a ball drop tool, or ball drop assembly for use with a coiled tubing which provides both a method and apparatus for dropping a ball through a tool string so that it will engage a ball seat. The ball drop tool has a housing with upper and lower ends adapted to be connected into a tool string which is connected to a length of coiled tubing. A ball drop cage is disposed in the housing. An actuating device, such as an actuating ball, is releasably retained in the housing and is preferably releasably retained in the ball drop cage which is disposed in the housing. The ball drop cage is positioned in the tool string above a first seat, which may be referred to as an actuating seat. The actuating ball is releasably retained in the ball drop cage with a rocker arm, and preferably with a plurality of rocker arms that are pivotally connected to the ball drop cage. The ball drop cage is movable from a retaining position in which the actuating ball is releasably retained in the ball drop cage to a releasing position in which the actuating ball is released so that it can travel downwardly in the tool string to engage the actuating seat therebelow. When the actuating ball engages the actuating seat, pressure in the tool string can be increased to actuate any mechanism associated with the ball drop seat.

The ball drop tool may also include a seat sleeve positioned in the housing. The seat sleeve defines a releasing seat. A releasing device, such as a releasing ball which has a smaller diameter than that of the actuating ball so that it can pass through any restrictive diameters or flow passages may be displaced into the tool string. When the releasing ball engages the releasing seat, pressure may be increased to cause the seat sleeve to move downwardly from a first position to a second position. The seat sleeve is connected to the ball drop cage so that when the seat sleeve moves downwardly, the ball drop cage will move downwardly causing the rocker arms to rotate and release the actuating ball. Movement of the seat sleeve from the first to the second position opens a fluid flow path that allows fluid to flow downwardly in the tool string to urge the actuating ball downwardly so that it will engage the actuating seat and to provide for an increase in pressure after the actuating ball has engaged the actuating seat.

BRIEF DESCRIPTION OF THE DRAWINGS

FIG. 6 is a perspective view of the releasing seat sleeve of the present invention.

DESCRIPTION OF THE PREFERRED EMBODIMENTS

After a well has been drilled, completed, and/or placed in production, it is often necessary to perform any number of procedures therein such as but not limited to perforating, setting plugs, setting cement retainers, spotting permanent packers, and the like. Such procedures are often carried out by utilizing coiled tubing. Coiled tubing is a flexible tubing which can be stored on a reel when not being used. When used for performing well procedures, the coiled tubing is passed through an injector mechanism, and a well tool is connected to the end thereof. A variety of tools may be connected in a tool string lowered in the well on the coiled tubing, and very often one of the tools will have a seat which may be referred to as a ball seat or an actuating seat, for receiving an actuating ball or other actuating device. Once the actuating device has engaged the actuating seat, pressure can be increased to actuate a mechanism in the tool string. The use of dropped balls and other actuating devices through coiled tubing, and the use of ball seats in connection with a variety of tools, including but not limited to hydraulic disconnects, inflatable packers, hydraulic setting tools, and pressure firing heads is common and is well known.

Coiled tubing is typically pulled from the reel by the injector mechanism, often referred to as a stuffing box, which straightens the coiled tubing and injects it through a seal assembly at the wellhead. Typically, the injector mechanism injects thousands of feet of the coiled tubing with a well tool connected at the bottom end thereof into the casing string or the production tubing string of the well. A fluid, most often a liquid such as salt water, brine, or a hydrocarbon liquid, may be circulated through the coiled tubing for operating well tools or for other purposes. The coiled tubing injector is used to raise and lower the coiled tubing and the well tool or tools during the service procedure and to remove the coiled tubing and well tools as the tubing is rewound on the reel at the end of the procedure.

Figures 1, 4:
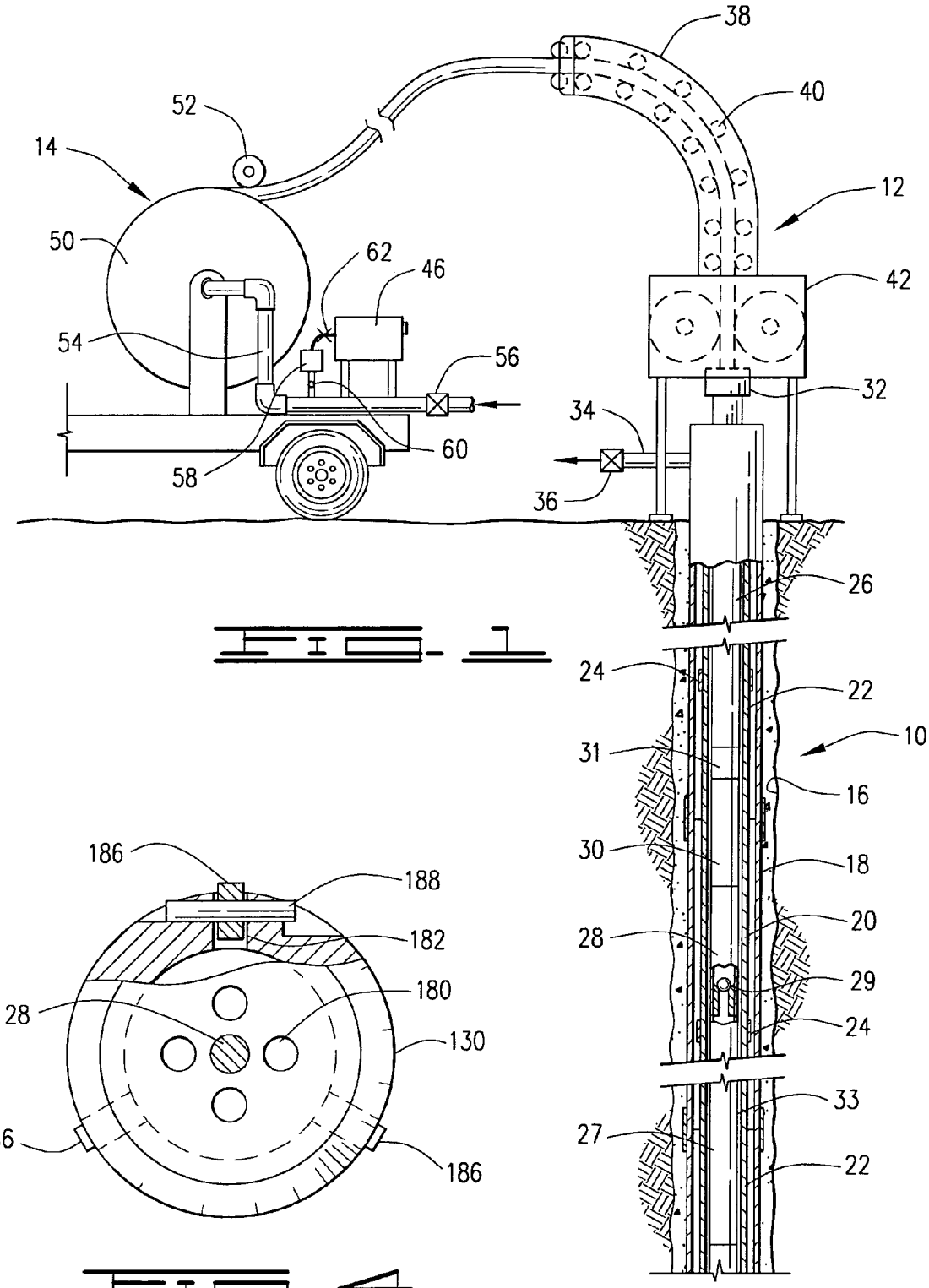
FIG. 1 is a schematic illustration of a cased well having a string of production tubing disposed therein and having a length of coiled tubing with a tool string including the downhole ball drop tool of the present invention inserted into the well by a coiled tubing injector and truck mounted reel.
FIG. 4 shows a partial section of the end view of the ball cage of the present invention.

Referring now to FIG. 1, a well 10 is schematically illustrated along with a coiled tubing injector 12 and a truck mounted coiled tubing reel assembly 14. Well 10 includes a wellbore 16 having a string of casing 18 cemented therein. A string of production tubing 20 is also shown installed in well 10 within casing 18. Production tubing 20 may be made up of a plurality of tubing sections 22 connected by a plurality of joints or collars 24 in a manner known in the art.

A length of coiled tubing 26 is shown positioned in production tubing 20. A tool string 27 including a downhole tool 28 is connected to coiled tubing 26. Tool 28 has a ball seat 29, which may be referred to as an actuating seat 29, therein for receiving an actuating ball or other actuating device. A ball drop tool, which may be referred to as a ball drop assembly or ball drop apparatus, of the present invention is generally designated in FIG. 1 by the numeral 30. Ball drop tool 30 may be connected to the lower end of coiled tubing 26 with an adapter 31 or may be connected to coiled tubing 26 with other tools or joint connectors which may be located in tool string 27 above the ball drop tool 30. Other well tools may be attached above or below tool 28. An annulus 33 is defined between tool string 27 and production tubing 20. Although the tool string 27 is shown disposed in production tubing 20, it may be disposed directly in casing 18, in which case an annulus would be defined between tool string 27 and casing 18.

Coiled tubing 26 is inserted into well 10 by coiled tubing injector 12 through a stuffing box 32. Stuffing box 32 functions to provide a seal between coiled tubing 26 and production tubing 20 whereby pressurized fluids within well 10 are prevented from escaping to the atmosphere. A circulating fluid removal conduit 34 having a shutoff valve 36 therein is sealingly connected to the top of casing 18. Fluid circulated into well 10 through coiled tubing 26 is removed from the well 10 through fluid removal conduit 34 and shutoff valve 36 and routed to a pit, tank, or other fluid accumulator.

Coiled tubing injector 12 is of a kind known in the art and functions to straighten coiled tubing 26 and inject it into well 10 through stuffing box 32 as previously mentioned. Coiled tubing injector 12 comprises a guide mechanism 38, commonly referred to as a gooseneck, having a plurality of guide rollers 40 therein and a coiled tubing drive mechanism 42 which is used for inserting coiled tubing 26 into well 10, raising the coiled tubing 26 or lowering it within the well 10, and removing the coiled tubing 26 from the well 10 as it is rewound on reel assembly 14.

Truck mounted reel assembly 14 includes a reel 50 on which coiled tubing 26 is wound. A measuring wheel 52 measures the coiled tubing 26 that is wound off of reel 50. A conduit assembly 54 is connected to the end of coiled tubing 26 on reel 50 by a swivel system (not shown). A shutoff valve 56 is disposed in conduit assembly 54, and conduit assembly 54 is connected to a fluid pump (not shown) which pumps fluid to be circulated from the pit, tank, or other fluid communicator through conduit assembly 54 and into coiled tubing 26. If an actuating ball is to be dropped without the use of the ball drop tool 30 of the present invention or that described in the '360 patent, the actuating ball may be inserted in the piping between the coiled tubing 26 and the shutoff valve 56. Balls may also be introduced upstream of the shutoff valve 56 and pumped therethrough. In either case, balls introduced in this manner must pass through the wraps of coiled tubing 26 on the reel 50.

A fluid pressure sensing device and transducer 58 may be connected to conduit assembly 54 by connection 60, and the fluid pressure sensing and transducer device 58 may be connected to a data acquisition system 46 by an electric cable 62. As will be understood by those skilled in the art, data acquisition system 46 may function to record the surface pressure of fluid being pumped through the coiled tubing 26. Other known methods may also be used to record fluid pressure.

Figure 2:
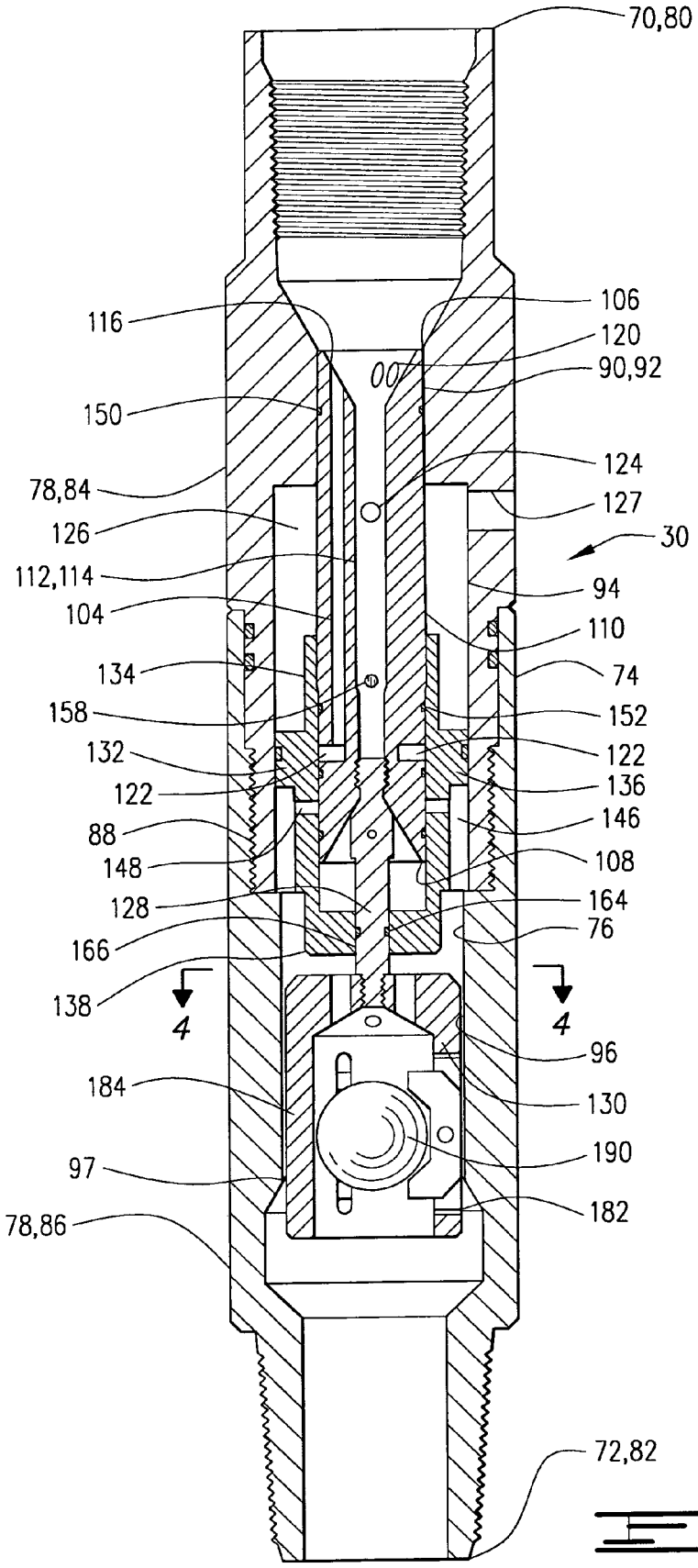
FIGS. 2 and 3 show cross sections of the ball drop tool of the present invention in retaining and releasing positions, respectively.
Figure 3:
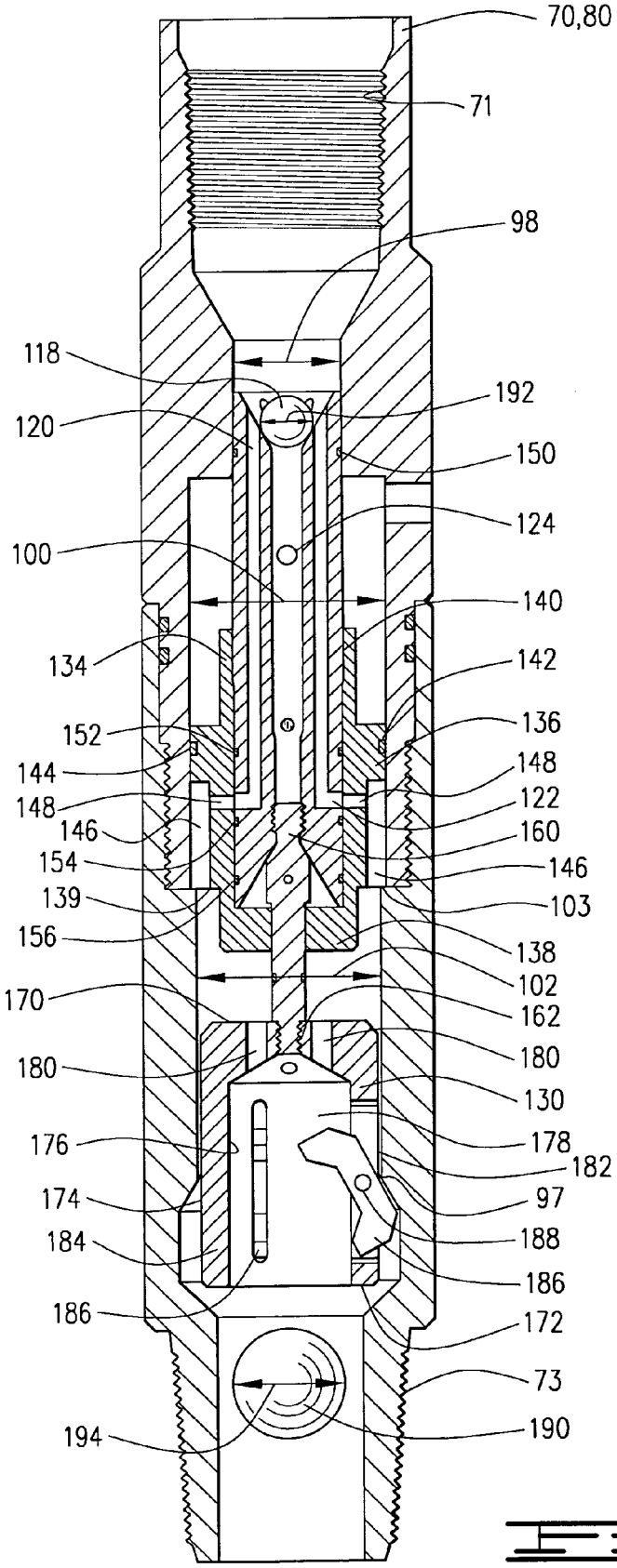

Referring now to FIGS. 2 and 3, ball drop tool 30 has upper end 70 and lower end 72, both of which are adapted to be connected in tool string 27. In the embodiment shown, upper end 70 has internal threads 71, and lower end 72 has external threads 73, so that ball drop assembly 30 may be connected in tool string 27. Although threads are shown, other means known in the art for connecting ball drop assembly 30 in tool string 27 may be utilized. Ball drop assembly 30 has outer surface 74 and inner surface 76. Ball drop assembly 30 comprises an housing 78 having upper end 80 and lower end 82. Housing 78 has an upper or top sub 84 and a lower or bottom sub 86 connected at threaded connection 88. Housing 78 defines a central opening 90 which may include a first or upper central opening 92, a second or intermediate central opening 94, and a third or lower central opening 96. Lower central opening 96 of housing 78 has a lower end 97. Upper central opening 92 defines a first inner diameter 98. Second and third central openings 94 and 96 define second and third inner diameters 100 and 102, respectively. In the embodiment shown, second inner diameter 100 has a magnitude greater than that of first inner diameter 98 and third inner diameter 102 and third inner diameter 102 has a magnitude greater than first inner diameter 98. An upward facing shoulder 103 is defined by second and third central openings 94 and 96, respectively. A releasing seat sleeve 104 is detachably disposed in housing 78. Releasing seat sleeve 104 has an upper end 106, a lower end 108, an outer surface 110, and an inner surface 112 defining a central flow passage 114. Releasing seat sleeve 104 defines a releasing seat 116 at or near the upper end 106 thereof. As will be explained in more detail hereinbelow, releasing seat 116 is adapted to engage a releasing device such as releasing ball 118 or other releasing device.

A plurality of axial flow ports 120 and preferably six axial flow ports 120 are defined in releasing seat sleeve 104 and extend from releasing seat 116 downwardly for at least a portion of the length of releasing seat sleeve 104 until they intersect a groove 122. At least one radial port 124 and preferably a plurality of radial ports 124 are defined in releasing seat sleeve 104 and provide communication between central flow passage 114 and an annulus 126 defined between releasing seat sleeve 104 and second central opening 94. Radial ports 124 are positioned so that they do not intersect with axial flow ports 120. A fluid port 127 provides communication between second central opening 94 and well 10, and in the embodiment shown provides communication between second central opening 94 and annulus 33. If ball drop tool 30 is placed directly in casing 18, fluid port 127 will communicate fluid between second central opening 94 and the annulus defined by the ball drop tool 30 and casing 18.

A connecting rod 128 connects releasing seat sleeve 104 with ball drop cage 130. In the embodiment shown, connecting rod 128 is threadedly connected to releasing seat sleeve 104 and is movable therewith. Releasing seat sleeve 104 is slidably and sealably disposed in upper central opening 92 and is detachably connected to a releasing seat body 132.

Figure 5:
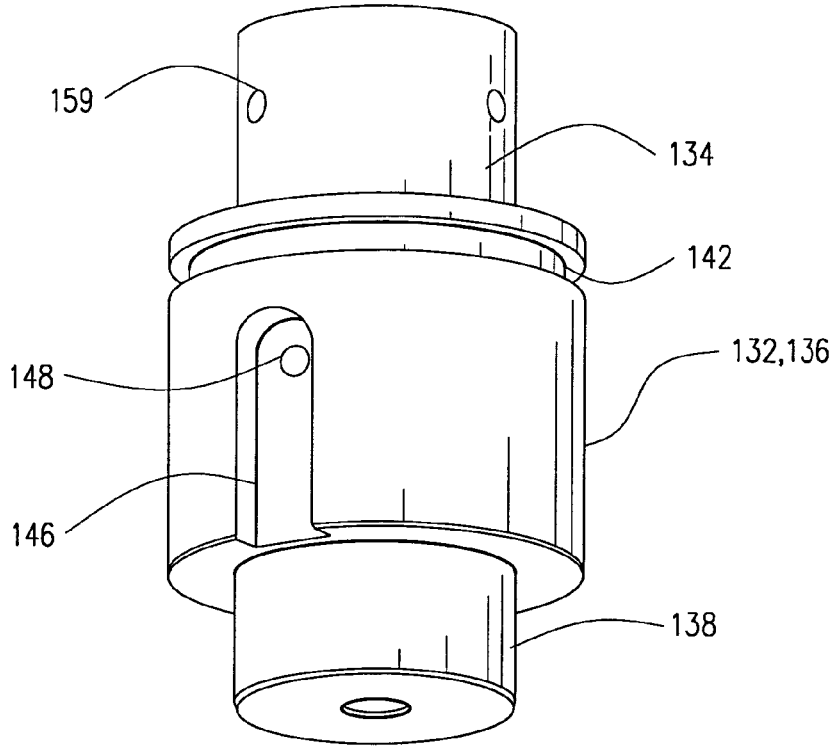
FIG. 5 is a perspective view of the releasing seat body of the present invention.
Figure 5:
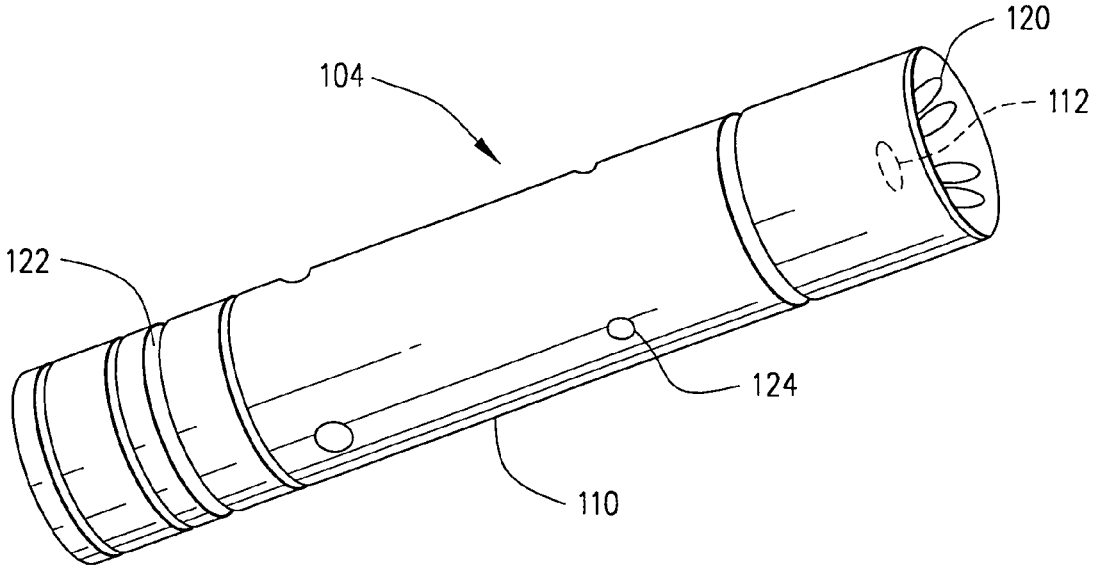

Releasing seat body 132 is disposed in housing 78, and has an upper or neck portion 134, a central portion 136, and a lower or tail portion 138. Central portion 136 defines a downward facing shoulder 139. Downward facing shoulder 139 engages upward facing shoulder 103 and prevents releasing seat body 132 from moving downwardly in tool string 27. Releasing seat body 132 defines a central opening 140 therethrough in which releasing seat sleeve 104 is disposed. Central portion 136 has a groove 142 defined therein for holding an O-ring seal or other seal 144 so that releasing seat body 132 sealingly engages central opening 90 of housing 78. Releasing seat body 132 has at least one and preferably a plurality of longitudinal grooves 146 in the exterior thereof. Longitudinal grooves 146 are communicated with central opening 140 through a plurality of radial ports 148. A perspective view of releasing seat body 132 is shown in FIG. 5, and a perspective view of releasing seat sleeve 104 is shown in FIG. 6. Releasing seat sleeve 104 has a plurality of seals disposed about the outer surface thereof including first seal 150, second seal 152, third seal 154, and fourth seal 156. First seal 150 sealingly engages upper central opening 92 of housing 78. Second, third, and fourth seals 152, 154, and 156, respectively, engage central opening 140 of releasing seat body 132. Releasing seat sleeve 104 is detachably connected to releasing seat body 132 with a shear pin 158 or other means known in the art. Releasing seat body 132 has openings 159 for receiving shear pins 158. Releasing seat sleeve 104 is slidable in releasing seat body 132 and in housing 78 after shear pin 158 shears, detaching the releasing seat sleeve 104 from releasing seat body 132.

Connecting rod 128 has upper end 160 threadedly connected to releasing seat sleeve 104 and lower end 162 threadedly connected to ball drop cage 130. Connecting rod 128 has a seal 164 for sealingly engaging releasing seat body 132 when it is in the position shown in FIG. 2. Connecting rod 128 passes through a connecting rod opening 166 defined in releasing seat body 132.

As shown in FIGS. 2–4, ball drop cage 130 has upper end 170, lower end 172, outer surface 174, and an inner surface 176 that defines ball drop cage interior 178. Ball drop cage 130 has a plurality of openings or flow ports 180 at the upper end 170 thereof which communicate cage interior 178 with central opening 90 of housing 78. Ball drop cage 130 has a plurality of slots 182 defined in wall 184 thereof. Rocker arms 186 are pivotably connected to wall 184 with pins 188 which are preferably self-locking pins. Referring now back to FIG. 2, ball drop cage 130 and thus ball drop assembly 30 is shown in a first, or retaining position wherein an actuating device such as an actuating ball 190 is retained in ball drop cage 130. When ball drop cage 130 is in the retaining position, such as for example when ball drop tool 30 along with other tools in the tool string 27 is being lowered into the wellbore 16, fluid may be circulated through coiled tubing 26 into housing 78. Fluid will pass through radial ports 124 into annulus 126 and through fluid ports 127 so that in the embodiment shown, fluid is communicated into production tubing 20. When no production tubing is present, fluid will be communicated through fluid ports 127 into well 10. Second seal 152 is positioned above groove 122 and third seal 154 is positioned therebelow. Thus, no fluid is allowed to pass through the plurality of axial flow ports 120 when ball drop cage 130 is in its retaining position as shown in FIG. 2.

If it is desired to actuate a tool in tool string 27 by using actuating ball 190, releasing ball 118 may be displaced through coiled tubing 26 in any manner known in the art until releasing ball 118 engages releasing seat 116. Releasing ball 118 has an outer dimension or outer diameter 192 smaller than an outer dimension or outer diameter 194 of actuating ball 190. Releasing ball 118 may thus pass through tools or mechanisms thereabove that have restrictive flow paths or restrictive diameters that will not allow passage of a ball the size of actuating ball 190 but that will allow passage of a smaller ball, such as releasing ball 118. When releasing ball 118 engages releasing seat 116, it blocks flow through central flow passage 114 and radial ports 124. Increased pressure or flow of fluid above releasing seat 116 will cause releasing seat sleeve 104 to move downwardly to the second, or releasing position shown in FIG. 3. Downward movement of releasing seat sleeve 104 causes ball drop cage 130 to move downwardly because of the connection of releasing seat sleeve 104 with ball drop cage 130 by connecting rod 128. Rocker arms 186 rotate to allow actuating ball 190 to be released so that it will pass downwardly in tool string 27 so that it engages ball seat 29. Central opening 90 of housing 78 slopes outwardly from lower end 97 of lower central opening 96, so that lower end 97 acts as a fulcrum and allows rocker arms 186 to rotate about pins 188 to release actuating ball 190.

In the releasing position, fluid will flow through coiled tubing 26 into and through axial flow ports 120 and groove 122 wherein the fluid is communicated into radial ports 148 in releasing seat body 132. Fluid is then communicated through longitudinal grooves 146 and passes into lower central opening 96 of housing 78. Fluid can continue to flow downwardly through openings 180 and may pass around ball drop cage 130. Fluid flow may be increased to a desired rate, and thus pressure increased to a desired level in tool string 27 after actuating ball 190 engages ball seat 29 so that any desired tool or mechanism associated with ball seat 29 may be actuated, including those set forth herein or any other tool or mechanism that requires an increase in pressure, or a redirection of flow caused by a ball or other actuating device engaging a seat.

In the preferred embodiment, fluid may be circulated through tool string 27 but is not allowed to flow downwardly to engage actuating ball 190 until releasing ball 118 has been dropped and has engaged releasing seat 116. Prior to the time releasing ball 118 engages releasing seat 116, fluid may be circulated through radial ports 124 outside tool string 27 to provide a circulation path when the tool string 27 is lowered into well 10, or any other time prior to the engagement of releasing ball 118 with releasing seat 116. Once releasing ball 118 engages releasing seat 116, flow into central flow passage 114 is blocked and fluid flow and thus pressure may be increased to a desired amount to cause shear pin 158 to break so that releasing seat sleeve 104 is slidably movable in housing 78 and in releasing seat body 132. Releasing ball 118 thus comprises a flow restriction. Movement of releasing seat sleeve 104 from the first position shown in FIG. 2 to the second position shown in FIG. 3 also establishes and provides a flow path for fluid as described hereinabove so that fluid may flow through tool string 27 and contact actuating ball 190 so that when actuating ball 190 engages ball seat 29, pressure in tool string 27 can be increased to the desired amount to actuate the desired tool or mechanism. Thus, a flow path through tool string 27 to actuating ball 190 is provided substantially simultaneously with the releasing of actuating ball 190. The present invention thus provides a method for retaining an actuating device, such as actuating ball 190 until a desired time and releasing the actuating ball 190 at that time. The invention further provides a method for retaining an actuating ball having a size that will not pass through restrictive flow passages or diameters in a tool string and for carrying the actuating ball into a well and releasing the actuating ball.

It will be seen that the ball drop tool 30 of the present invention is well adapted to carry out the ends and advantages mentioned, as well as those inherent therein. While presently preferred embodiments of the apparatus have been described for the purposes of this disclosure, numerous changes in the arrangement and construction of parts may be made by those skilled in the art. All such changes are encompassed within the spirit and scope of the appended claims.

What is claimed is:

1. A ball drop apparatus for use in a tool string, comprising:

a housing;

a ball drop cage disposed in the housing;

an actuating ball releasably disposed in the ball drop cage, wherein the actuating ball has an outermost dimension, the ball drop cage being movable in the housing from a retaining position, wherein the actuating ball is retained in the ball drop cage, to a releasing position, wherein the actuating ball is released and can move downwardly in the tool string; and a seat in the housing adapted to receive a releasing device;

wherein the releasing device has an outermost dimension smaller than the outermost dimension of the actuating ball, the actuating ball is released into the tool string when the releasing device engages the seat and pressure in the tool string is increased to a desired pressure, and the released actuating ball can engage a downhole tool located in the tool string.

2. The ball drop apparatus of claim 1 further comprising a seat sleeve disposed in the housing, wherein the seat is defined on the seat sleeve, and the seat sleeve is connected to the ball drop cage so that downward movement of the seat sleeve urges the ball drop cage downwardly to the releasing position to release the actuating ball.

3. The ball drop apparatus of claim 1 wherein the seat sleeve is releasably disposed in the housing.

4. The ball drop apparatus of claim 3 wherein the seat sleeve moves in the housing after the releasing device engages the seat and pressure is increased in the tool string to a desired pressure.

5. A ball drop apparatus for use in a tool string, wherein the tool string has an actuating seat for receiving an actuating ball to actuate a tool in the tool string, comprising:

a housing adapted to be connected in the tool string above the actuating seat, wherein the actuating ball is releasably retained in the housing; and a sleeve detachably disposed in the housing above the actuating ball, wherein movement of the sleeve from a first position to a second position releases the actuating ball for displacement downwardly in the tool string to engage the actuating seat, wherein a flow path for providing fluid to the actuating ball is defined through, wherein the flow path is blocked when the sleeve is in the first position, and the flow path is open when the sleeve is in the second position.

6. The ball drop apparatus of claim 5 wherein the sleeve comprises a releasing seat, wherein the releasing seat is adapted to receive a releasing ball, and the sleeve moves from the first position to the second position after the releasing ball has engaged the releasing seat.

7. The ball drop apparatus of claim 5 further comprising a ball drop cage disposed in the housing, wherein the actuating ball is releasably retained in the ball drop cage, the sleeve is connected to the ball drop cage so that the ball drop cage moves from a retaining position to a releasing position wherein the actuating ball is released when the sleeve moves from the first position to the second position.

8. The ball drop apparatus of claim 7 wherein the sleeve comprises a releasing seat for receiving a releasing ball.

9. The ball drop apparatus of claim 8 wherein the sleeve defines a central flow passage in fluid communication with an exterior of the housing, and the central flow passage is blocked when the releasing ball engages the releasing seat.

10. A method of actuating a tool in a tool string in a well, wherein the tool string has an actuating seat therein for receiving an actuating ball, comprising the steps of:

releasably positioning the actuating ball in a ball cage disposed in the tool string above the actuating seat;

lowering the tool string into the well;

displacing a flow restriction into the tool string;

landing the flow restriction on a releasing seat located in the tool string above the actuating seat;

moving the ball cage downwardly to release the actuating ball so that the actuating ball engages the actuating seat; and increasing pressure in the tool string to actuate the tool.

11. The method of claim 10 further comprising the step of blocking fluid flow in the tool string to prevent fluid from passing therethrough and contacting the actuating device prior to the releasing step.

12. The method of claim 11 further comprising the step of opening a fluid flow path through the tool string so that fluid may be displaced therethrough to contact the actuating device, wherein the opening step occurs substantially simultaneously with or after the releasing step.

13. The method of claim 10 wherein the actuating device is disposed in a ball drop cage movable from a retaining position to a releasing position, and the releasing seat is defined by a sleeve detachably connected in the tool string, wherein the method further comprises the step of urging the ball drop cage from the retaining position to the releasing position with downward movement of the sleeve.

14. The method of claim 13 wherein the urging step comprises the step of increasing pressure in the tool string after the flow restriction has landed on the releasing seat.

15. The method of claim 10 further comprising the steps of:

drilling the well to intersect a producing formation; and placing a casing in the well.

16. The method of claim 10 further comprising the step of increasing pressure in the tool string after the landing step, wherein the increase in pressure causes the actuating ball to be released.

17. The method of claim 10 further comprising the step of moving the releasing seat downwardly after the landing step, wherein downward movement of the releasing seat causes the actuating ball to be released.

18. The method of claim 10 wherein the releasing seat is defined on a sleeve connected to the ball cage, and downward movement of the sleeve moves the ball cage downwardly.

19. A ball drop apparatus for use in a tool string comprising:

a housing;

a ball drop cage disposed in the housing;

an actuating ball releasably in the ball drop cage; and a sleeve disposed in the housing above the ball drop cage, wherein the sleeve has a plurality of longitudinally extending flow passages for allowing flow therethrough to the actuating ball, wherein flow through the longitudinally extending flow passages is blocked in a first position of the sleeve and is permitted in a second position of the sleeve.

20. The ball drop apparatus of claim 19 wherein the ball drop cage is connected to and movable with the sleeve.

21. The ball drop apparatus of claim 19 wherein the sleeve has a central flow passage communicated with an exterior of the housing.

22. The ball drop apparatus of claim 21 wherein the sleeve moves from the first to the second position when a releasing device blocks flow through the central flow passage.

23. The ball drop apparatus of claim 19 wherein movement of the sleeve from the first position to the second position releases the actuating ball for displacement downwardly in the tool string.

* * * * *